United States Patent [19]

Slack

[11] Patent Number: 4,555,684

[45] Date of Patent: Nov. 26, 1985

[54] MOTOR STARTING DEVICE

[75] Inventor: Douglas J. Slack, Smithfield Plains, Australia

[73] Assignee: Texas Instruments Incorporated, Dallas, Tex.

[21] Appl. No.: 639,106

[22] PCT Filed: Dec. 9, 1983

[86] PCT No.: PCT/AU83/00181

§ 371 Date: Aug. 9, 1984

§ 102(e) Date: Aug. 9, 1984

[87] PCT Pub. No.: WO84/02425

PCT Pub. Date: Jun. 21, 1984

[51] Int. Cl.[4] ..... H01H 7/06; H01H 43/02

[52] U.S. Cl. ..... 335/66; 335/141; 337/54

[58] Field of Search ..... 335/66, 145, 141, 144; 337/54, 68

[56] References Cited

U.S. PATENT DOCUMENTS 1,828,299 10/1931 Shuey ..... 335/145
2,376,759 5/1945 Dyer et al. ..... 335/145

FOREIGN PATENT DOCUMENTS 308300 3/1933 Italy ..... 335/145

*Primary Examiner*—Harold Broome
*Attorney, Agent, or Firm*—John A. Haug; James P. McAndrews; Melvin Sharp

[57] ABSTRACT

A motor starting device for de-energizing the starting winding the required motor speed is reached comprising electromagnetic means (3) to urge actuation of the switching means (20,21) and a latch member (10) controlled by a thermal temperature-balanced bimetallic strip (5) to prevent switching until the bimetallic strip (5) reaches a selected temperature through current flow flow therethrough.

16 Claims, 4 Drawing Figures

MOTOR STARTING DEVICE

FIELD OF THE INVENTION

This invention relates to a motor starting device and in particular it relates to a device of the type which controls the energization of a start winding to run the motor up to speed to be then switched over to continued operation, the start winding being de-energized during the running period of the motor.

OBJECT OF THE INVENTION

Many forms of such devices have been known in the past, but the object of the present invention is to provide a device which introduces a time element in the switching of the start winding independent of the current draw which is taking place for instance in the electromagnetic coil, the purpose of this being to overcome the difficulty which exists at present when a motor is switched on and then switched off and again switched on without leaving a sufficient time delay for the mechanism to reset itself.

SUMMARY OF THE INVENTION

The present invention utilises an electromagnetic coil in the normal way in circuit with the motor winding which coil includes a spring loaded pivoted keeper which is pulled down by energization of the coil, but the motor start winding is controlled independently of this by a bimetallic strip connected so that there is a current flow through the bimetallic strip to the start winding through contacts under control of a contact blade held in position by a latch member which is arranged to be engaged and held by the bimetallic strip until such time as the bimetallic strip is sufficiently heated to release the latch member and break the hold by allowing the contact blade to return.

Thus the invention relates in general to a motor starting device adapted to de-energize the starter winding when the motor has attained the required speed and torque, and according to a preferred form a housing supports an electromagnetic coil arranged to actuate switch means in the housing, the invention being characterized by a latch member connected between the electromagentic coil and the switching means, and by a bimetallic strip which may be in series with the electromagnetic coil or otherwise energised, the bimetallic strip being connected to hold the latch member against displacement by the electromagnetic coil until the bimetallic strip is heated, the latch member having means to actuate the switch means.

A preferred feature is a keeper fulcrumed to actuate the latch member and spring connected to be returned after pull from the electromagnetic coil, and also spring connected to the latch member to urge the end portion of the latch member against the keeper.

A further preferred feature is an arrangement of switch blades to be actuated by displacement of the latch member, but under control of the bimetallic strip which releases the latch member to move only when the bimetallic strip has been heated by current flow to the motor.

The device can be summarised as comprising an electromagentic coil to initiate the switching action by setting a keeper, and a bimetallic strip to prevent actual switching occurring until the bimetallic strip reaches a selected temperature.

DESCRIPTION OF THE ILLUSTRATED PREFERRED EMBODIMENT

Figure 2:
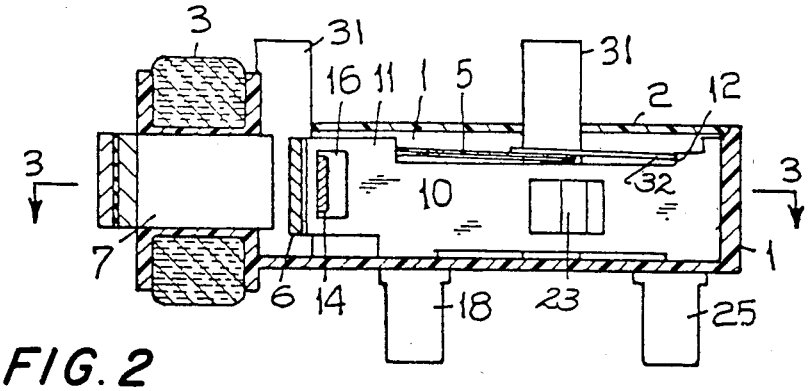
FIG. 2 is a section of same on line 2—2 of FIG. 1.
Figure 1:
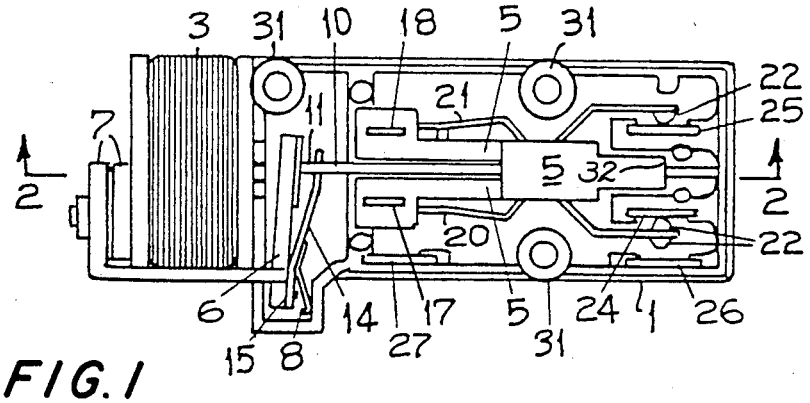
FIG. 1 is a plan of the device with the cover removed.

The housing 1 has a cover 2 and has at one end an electromagnetic coil 3 and within the housing switch means and a bimetallic strip 5.

The electromagnetic coil 3 has a keeper 6 which is hingedly supported on the core 7 of the electromagnetic coil 3, the free end of the keeper 6 being urged away from the core by a return spring 8 when the coil is not energised.

Slidable within the housing 1 is a latch member 10 which is located between guides and has one end 11 adjacent the free end of the keeper 6 and has near the other end a notch 12 at the end of a face 13.

The end 11 is urged into contact with the free end of the keeper 6 by a blade spring 14 which is secured at the end 15 to the fulcrumed end part of the keeper 6 and has its other end project through an aperture 16 in the latch member 10.

The return blade spring 8 has its end engaged against a part of the housing 1 and is arranged to urge the free end of the keeper 6 away from the core 7 so that when no current flow exists in the coil 3 the free end of the keeper 6 pushes the latch member 10 back to a position where the end of a bimetallic strip 5 engages the notch 12 and, unless the bimetallic strip 5 is heated, the latch member cannot return to its forward position even though the free end of the keeper 6 is pulled against the core 7. If this occurs the blade spring 14 is tensioned in readiness to move the latch member 10 to actuate the switch when the temperature of the strip reaches a sufficient value to disengage from the notch 12.

The bimetallic strip 5 is bifurcated as illustrated and held to project from a pair of terminal blades 17 and 18 so that the free end 32 of the bimetallic strip 5 is disposed adjacent to the notch 12, the bimetallic strip 5 being positioned to have its end engaged in the notch 12 only when not heated. By this arrangement when the strip is heated by the current flowing to the start winding, the bimetallic strip flexes and its end portion is withdrawn from contact with the notch 12 to release the latch member which is then pushed back into contact with the keeper 6 by the flexure of the blade spring 14, at which stage the current flow to the starter winding is terminated.

The bimetallic strip 5 will be seen to be made in two parts, A and B, the bifurcated part A being the current carrying part, the expanding part B being a temperature compensating part moving oppositely under ambient temperature to temperature-stabilize the end which engages the notch 12 to always remain in the notch-engaging position excepting when current flow takes place in the bifurcated part A.

The device is reset as soon as the motor is switched on, through the magnetic coil 3 drawing the free end of the keeper 6 down, but the bimetallic strip 5 at this stage has cooled and the latch member 10 is held by it to hold the start winding contacts engaged until such time as the current flowing through the bimetallic strip heats it sufficiently to flex it to release the latch member 10.

The terminal blades 17 and 18 also support the switch blades 20 and 21 which have contacts 22 at their free ends, these switch blades 20 and 21 being curved inwardly at their intermediate portions to engage a ramp 23 on the latch member 10, the purpose of this ramp 23 being to force the contact ends of the two switch blades outwardly away from the terminal blades 24 and 25 which form power outlets for the motor starting device.

Figure 3:
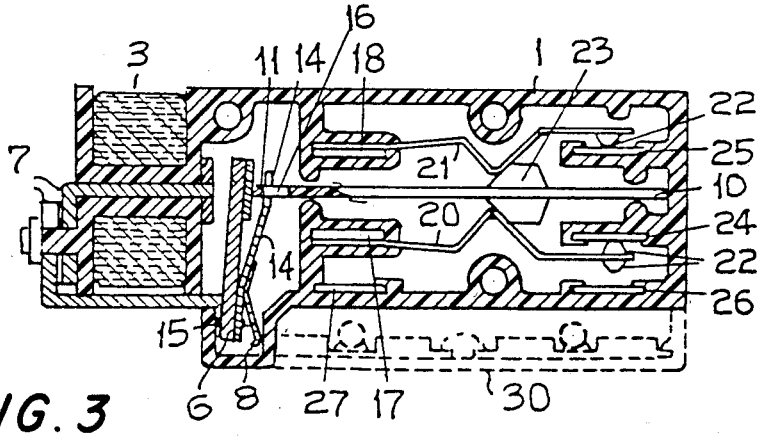
FIG. 3 is a plan showing particularly the switching blades and contacts but with the case sectioned as on line 3—3 of FIG. 2.
Figure 4:
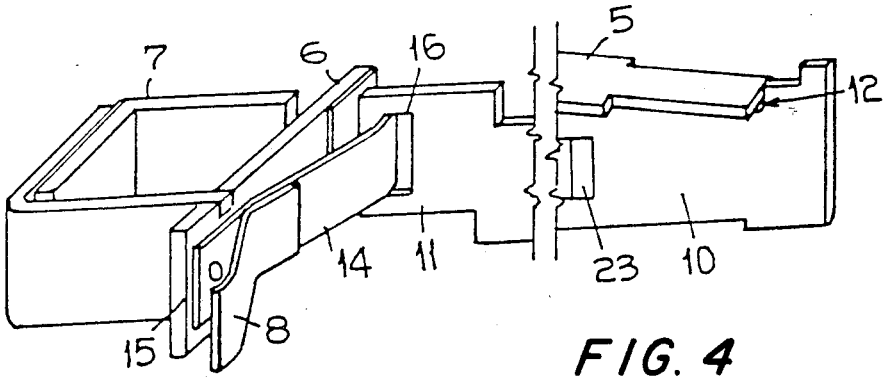
FIG. 4 is a schematic perspective view showing the interconnection between the keeper of the electromagnetic coil and the latch member, showing also how the bimetallic strip latches the keeper until the temperature of the strip reaches a required value.

The switch blades 20 and 21 are balanced about the latch member 10 which is loosely guided, as shown particularly in FIG. 3, by projections 28 on the body, thus allowing the switch blades to compensate for somewhat different spring characteristics.

The terminal blade 26 is active when the switch blade 20 is moved outwards when the latch member 10 is moved by the blade spring 14 after the bimetallic strip 5 is heated to disengage the end of the bimetallic strip 5 from the notch 12.

The terminal blade 27 is connected to one end of the electromagnetic coil 3, the other end connecting to the terminal blade 17.

The device can be used in various ways and when provided with a pair of contacts on the free end of one switch blade engaging either a terminal blade on one side which can for instance be coupled to a six-pole winding, or the contact on the other side arranged for a four-pole winding so that it will be realized that by using a latch member in this way and holding or releasing the latch member by a bimetallic strip member control of various functions can be effected by means not dependent on the amount of current flowing in the electromagnetic coil but by the bimetallic strip and its associated contact blade or blades, the electromagnetic coil being used merely to energize the keeper which, when no current flows in it, allows the keeper to be spring controlled to move the latch member into a position where it is engaged by the free end portion of the bimetallic strip and at that stage it holds the switch blade in the required closing position to restart the motor when current is again applied.

The term "bimetallic strip" covers other similar heat sensitive devices which can project to engage a notch in the latch member but is withdrawn when the strip is heated.

The bimetallic strip is used to operate contacts, (OPEN), and an electromagnetic coil is used to reset the contacts (CLOSE). The motor start winding is connected to a common terminal via normally closed contacts and the bimetallic strip, and the main winding is connected via the electromagnetic coil.

A single switch blade 20 or 21 could be used depending on the function required.

The dotted section 30 in FIG. 3 shows how the housing 1 can be extended to provide further connecting terminals. The housing can be mounted by using the mounting legs 31.

OPERATION OF THE DEVICE (a) The motor switch is energized to pull in the keeper 6 of the electromagnetic coil 3 but the switch transition does not take place because the latch member 10 is held by the free end of the bimetallic strip 5 engaging the notch 12.

(b) The bimetallic strip 5 heats due to start winding current flow through the bifurcated part of the bimetallic strip 5 and the free end releaes the latch member 10 after a predetermined time as set by the bimetallic strip, and switch transition occurs.

(c) The bimetallic strip 5 is now allowed to cool down while the motor continues to run, and the free end of the bimetallic strip 5 moves to rest on the face 13 on the latch member adjacent to the notch 12 and remains so while the motor runs.

(d) On switching off the motor the electromagnetic coil 3 is de-energised and the keeper spring 8 pushes the keeper and with it the latch member 10 back, and the free end of the metallic strip drops into the notch 12 of the latch member, and the motor start winding is now relatched for an immediate start.

I claim:

1. A motor starting device adapted to de-energize a start winding, the device having a housing supporting an electromagnetic coil and switch means, characterized by a movable latch member connected between a keeper means of the electromagnetic coil and the switch means, the keeper having a portion movable toward and away from the electromagnetic coil and being operatively connected to the latch member to move the latch member, and a current carrying bimetallic strip mounted in the housing, the bimetallic strip having at least a portion movable between a first unheated position when no current is being carried and a second heated position when current is being carried, the bimetallic strip adapted to hold the latch member against displacement by the keeper means of the electromagnetic coil until the bimetallic strip is heated by current flow, the latch member having means to actuate the switching means upon selected movement of the latch member.

2. A motor starting device according to claim 1 characterized in that the bimetallic strip is supported from the housing so that the movable portion engages a notch in the latch member when the bimetallic strip is in the unheated position whereby to hold the latch member against an urge to be moved by the keeper means until the movable portion of the bimetallic strip moves to the heated position.

3. A motor starting device according to claim 1 or 2 characterized in that the keeper means includes a keeper element fulcrumed near a first end portion and has a second end portion engageable by the latch member, and by a blade spring attached to the keeper element and engaging the latch member to urge the latch member against the second end portion of the keeper element.

4. A motor starting device according to claim 1 characterized in that the switch means has at least a switch blade which is moved to switch an electrical circuit by engagement with the means to actuate of the latch member.

5. A motor starting device according to claim 1 characterized in that the bimetallic strip is bifurcated so that it has bifurcated ends and the bifurcated ends are engaged and supported by terminal blades on the housing, means connecting two terminal blades to the electromagnetic coil, means connecting the terminal blades so that the electromagnetic coil and the bimetallic strip are electrically in series.

6. A motor starting device according to claim 5 characterized in that a switch blade is connected to one of the terminal blades which engages the bimetallic strip, the switch blade having contact means to engage at least another terminal blade supported by the housing.

7. A motor starting device according to claim 5 characterized in that a pair of switch blades are used, one connected to each of the terminal blades which engage the bimetallic strip, each switch blade having contact means to engage terminal blades supported by the housing.

8. A motor starting device according to claim 1 in which the keeper means includes a fulcrumed keeper element characterized in that the movable latch member is guided to slide in the housing and is positioned to be substantially normal to the keeper element fulcrumed remotely from the latch member, first spring means between the latch member and the keeper element to urge a first end of the latch member against the keeper element, second spring means to urge the keeper element away from the electromagnetic coil, the bimetallic strip being bifurcated and supported by the housing from a first end portion and having a second movable end portion engageable on the latch member to prevent movement of the latch member toward the electromagnetic coil when said coil is energized but to release the said latch member when the said bimetallic strip is heated so as to move under the urging of the first spring means.

9. A motor starting device according to claim 1 having ambient temperature stabilizing means characterized in that the bimetallic strip is formed in two parts, the first part being adapted to bend in a first direction when heated and being bifurcated and supported at one end and adapted to carry start current, and a second part adapted to bend in a direction opposite to the first direction when heated, the second part projecting from a free end of the bifurcated part to engage the latch member, the first and the second part being arranged to move in opposite directions under ambient temperature to form ambient temperature stabilizing means whereby the free end will remain in the latch member engaging position when the bimetallic strip is not in the current heated position.

10. A motor starting device according to claim 1 characterized in that the means to actuate the switching means comprise at least a switch blade supported by the housing to project generally parallel to the latch member, and by a ramp on the latch member to actuate the switch blade when the latch member is moved.

11. A motor starting device according to claim 8 characterized in that the means to actuate the switching means comprise a pair of spring switch blades arranged one on each side of the latch member, one end of each said switch blade being supported from the housing, the other end of each switch blade carrying contacts, an intermediate part of each switch blade engaging a ramp on the latch member whereby longitudinal movement of the latch member moves the contact ends of the switch blades to effect switching.

12. A motor starting device according to claim 11 characterized in that the latch member is loosely guided in the housing and is positionable laterally to a limited amount by pressure of the switch blades on the ramp.

13. A motor starting device according to claim 8 characterized in that the first spring means and the said second spring means comprise blade springs attached to the keeper element, the first spring means having a free end portion engaging the latch member and the second spring member having a free end portion engaging the housing.

14. A motor starting device comprising a housing, an electromagnetic coil mounted in the housing, means to energize the coil, the coil having keeper means including a keeper element hingedly mounted so that a free end of the element can move toward and away from the coil, spring means urging the free end of the keeper element away fromn the coil, a latch member movably mounted in the housing adapted to move toward and away from the coil, the keeper element being disposed between the coil and the latch member, spring means urging the latch member toward the keeper element, a current carrying bimetallic strip having at least a portion movable between a first unheated position when the strip is not conducting current and a second heated position when the strip is conducting current, the movable portion adapted to be in engagement with the latch member in at least one of the first and second positions to prevent movement of the latch member while in engagement therewith, means to conduct current through the bimetallic strip, switch means comprising a movable switch blade mounted in the housing and means on the latch member to engage the movable switch blade to actuate the switch means.

15. A motor starting device according to claim 14 in which the latch member is mounted in the housing between guides to allow the latch member to slide therebetween, the means on the latch member to engage the movable switch blade being a ramp surface, the movable switch blade having a bent surface portion adapted to be engaged and moved by the ramp surface upon sliding movement of the latch member.

16. A motor starting device according to claim 15 in which the bimetallic strip has a first end mounted in the housing and a free end portion, the latch member has a notch formed therein, the free end portion of the bimetallic strip adapted to engage the notch in the first unheated position.

* * * * *